US010285443B2

(12) United States Patent
Zhu

(10) Patent No.: US 10,285,443 B2
(45) Date of Patent: May 14, 2019

(54) PRESS-TYPE E-LIQUID SUPPLY MECHANISM AND ELECTRONIC CIGARETTES HAVING THE SAME

(71) Applicant: Xiaochun Zhu, Shenzhen (CN)

(72) Inventor: Xiaochun Zhu, Shenzhen (CN)

(73) Assignee: SHENZHEN KANGER TECHNOLOGY CO., LTD., Shenzhen (CN)

( * ) Notice: Subject to any disclaimer, the term of this patent is extended or adjusted under 35 U.S.C. 154(b) by 367 days.

(21) Appl. No.: 15/212,262

(22) Filed: Jul. 17, 2016

(65) Prior Publication Data

US 2018/0014572 A1 Jan. 18, 2018

(51) Int. Cl.

| | |
|---|---|
| ***A24F 47/00*** | (2006.01) |
| ***B65D 23/00*** | (2006.01) |
| ***B65D 41/04*** | (2006.01) |
| ***F04B 13/00*** | (2006.01) |
| ***F04B 53/12*** | (2006.01) |
| *F04B 9/14* | (2006.01) |
| *F04B 19/22* | (2006.01) |
| *F04B 53/14* | (2006.01) |

(52) U.S. Cl.

CPC ..... *A24F 47/008* (2013.01); *B65D 23/006* (2013.01); *B65D 41/0435* (2013.01); *F04B 13/00* (2013.01); *F04B 53/126* (2013.01); *F04B 9/14* (2013.01); *F04B 19/22* (2013.01); *F04B 53/14* (2013.01)

(58) Field of Classification Search

CPC ..... A24F 47/00; A24F 47/002; A24F 47/004; A24F 47/006; A24F 47/008; A61M 11/042; A61M 15/05; A61M 2205/3653; A61M 2205/8206; H05B 3/40; H05B 3/46; H05B 3/34; B65D 23/006; B65D 41/0457; B65D 41/0464; B65D 41/0471; B65D 41/0435; F04B 53/126; F04B 53/141; F04B 53/14; F04B 13/00; F04B 19/22

See application file for complete search history.

(56) References Cited

U.S. PATENT DOCUMENTS 4,017,031 A * 4/1977 Kishi ..... B05B 11/3016 222/321.2

2014/0261483 A1* 9/2014 Hopps ..... A24B 15/24 131/298

* cited by examiner

*Primary Examiner* — Shawntina T Fuqua

(74) *Attorney, Agent, or Firm* — Ming Jiang; MM IP Services LLC

(57) ABSTRACT

Present disclosure relates to an E-liquid supply mechanism and an electronic cigarette having the same. The E-liquid supply mechanism includes a stationary portion, a movable portion, and an E-liquid bottle. Stationary portion includes an E-liquid bottle lid, an E-liquid supply mechanism body, and an E-liquid supply intake tube. E-liquid supply mechanism body is attached to E-liquid bottle lid. E-liquid supply intake tube is attached to a low end of E-liquid supply mechanism body. Movable portion is positioned inside of E-liquid supply mechanism body and includes a press button, a first E-liquid tube, a supply piston, a second E-liquid tube, a spring, and a steel ball. First E-liquid tube is attached to the press button. The supply piston is attached to the first E-liquid tube. The second E-liquid tube is attached to the supply piston. The spring positioned under the second E-liquid tube, and the steel ball positioned under the spring.

18 Claims, 8 Drawing Sheets

PRESS-TYPE E-LIQUID SUPPLY MECHANISM AND ELECTRONIC CIGARETTES HAVING THE SAME

FIELD

The present disclosure generally relates to the field of electronic cigarette, and more particularly to a press-type E-liquid supply mechanism, electronic cigarettes having the press-type E-liquid supply mechanism, and a method of using the electronic cigarettes having the press-type E-liquid supply mechanism.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

The electronic cigarette is sometimes referred as electronic vaporing device, personal vaporizer (PV), or electronic nicotine delivery system (ENDS). It is a battery-powered device which simulates tobacco smoking. It generally uses a heating element that vaporizes a liquid solution (e-liquid). Some solutions contain a mixture of nicotine and a variety of flavorings, while others release a flavored vapor without nicotine. Many are designed to simulate smoking experience, such as cigarette smoking or cigar smoking. Some of them are made with similar appearance, while others are made considerably different in appearance.

Conventional electronic cigarettes have a small E-liquid storage tank and it requires a user of such electronic cigarette refilling E-liquid into the E-liquid storage tank quite frequently. Refilling E-liquid into the E-liquid storage tank is tedious and sometimes messy. The user has to open the electronic cigarette to refill E-liquid.

Therefore, an unaddressed need exists in the art to address the aforementioned deficiencies and inadequacies.

SUMMARY

In one aspect, the present disclosure relates to an E-liquid supply mechanism. In certain embodiments, the E-liquid supply mechanism includes: a stationary portion, a movable portion, and an E-liquid bottle. The stationary portion includes an E-liquid bottle lid, an E-liquid supply mechanism body, and an E-liquid supply intake tube. The E-liquid supply mechanism body is attached to the E-liquid bottle lid. The E-liquid supply intake tube is attached to a low end of the E-liquid supply mechanism body. The movable portion is positioned inside of the E-liquid supply mechanism body. The movable portion includes a press button, a first E-liquid tube, a supply piston, a second E-liquid tube, a spring, and a steel ball. The first E-liquid tube is attached to the press button. The supply piston is attached to the first E-liquid tube. The second E-liquid tube is attached to the supply piston. The spring positioned under the second E-liquid tube, and the steel ball positioned under the spring. In certain embodiments, when the press button is pressed by a user, the supply piston pushes down the second E-liquid tube to increase pressure inside the E-liquid supply mechanism body and pushes E-liquid inside the E-liquid supply mechanism body to flow through the second E-liquid tube, and the first E-liquid tube to supply E-liquid through the press button. When the press button is released, the spring pushes the supply piston upwards to decrease the pressure inside the E-liquid supply mechanism body such that the E-liquid in the E-liquid bottle enters the E-liquid supply mechanism body through the low end of the E-liquid supply mechanism body.

In another aspect, the present disclosure relates to an electronic cigarette. In certain embodiments, the electronic cigarette includes an electronic cigarette body, an E-liquid supply mechanism, and a flexible E-liquid tube configured to connect the E-liquid supply mechanism to the electronic cigarette body to supply E-liquid to the electronic cigarette body. In certain embodiments, the electronic cigarette body includes a vaporizer assembly and a vaporizer assembly E-liquid connector configured to receive E-liquid supply through the flexible E-liquid tube from the E-liquid supply mechanism. In certain embodiments, the E-liquid supply mechanism includes: a stationary portion, a movable portion, and an E-liquid bottle. The stationary portion includes an E-liquid bottle lid, an E-liquid supply mechanism body, and an E-liquid supply intake tube. The E-liquid supply mechanism body is attached to the E-liquid bottle lid. The E-liquid supply intake tube is attached to a low end of the E-liquid supply mechanism body. The movable portion is positioned inside of the E-liquid supply mechanism body. The movable portion includes a press button, a first E-liquid tube, a supply piston, a second E-liquid tube, a spring, and a steel ball. The first E-liquid tube is attached to the press button. The supply piston is attached to the first E-liquid tube. The second E-liquid tube is attached to the supply piston. The spring positioned under the second E-liquid tube, and the steel ball positioned under the spring.

In yet another aspect, the present disclosure relates to a method of using an electronic cigarette. In certain embodiments, the method includes: connecting a flexible E-liquid tube from an E-liquid supply mechanism connector of an E-liquid supply mechanism to a vaporizer assembly E-liquid connector of an electronic cigarette body, pressing a press button of the E-liquid supply mechanism in a reciprocating motion one or more times to supply E-liquid from an E-liquid bottle to a vaporizer assembly of the electronic cigarette body, and switching on a power supply module of the electronic cigarette body to energize a heating element inside the vaporizer assembly to generate E-liquid vapor. In certain embodiments, the method includes refilling E-liquid in the E-liquid bottle. The refilling includes: unscrewing an internal thread of an E-liquid bottle lid from an external thread of the E-liquid bottle to detach the E-liquid bottle, and replacing a new E-liquid bottle available off shelf in an E-liquid retail store.

These and other aspects of the present disclosure will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and, together with the written description, serve to explain the principles of the disclosure. Wherever possible, the same reference numbers are used throughout the drawings to refer to the same or like elements of an embodiment. The drawings do not limit the present disclosure to the specific embodiments disclosed and described herein. The drawings are not necessarily to scale, emphasis instead being placed upon clearly illustrating the principles of the disclosure, and wherein.

DETAILED DESCRIPTION

Figure 1B:
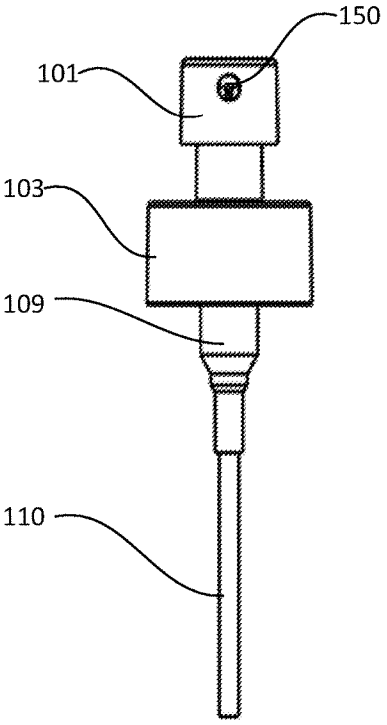
FIG. 1B is a side view of a portion of the E-liquid supply mechanism according to certain embodiments of the present disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 6.

Figure 1A:
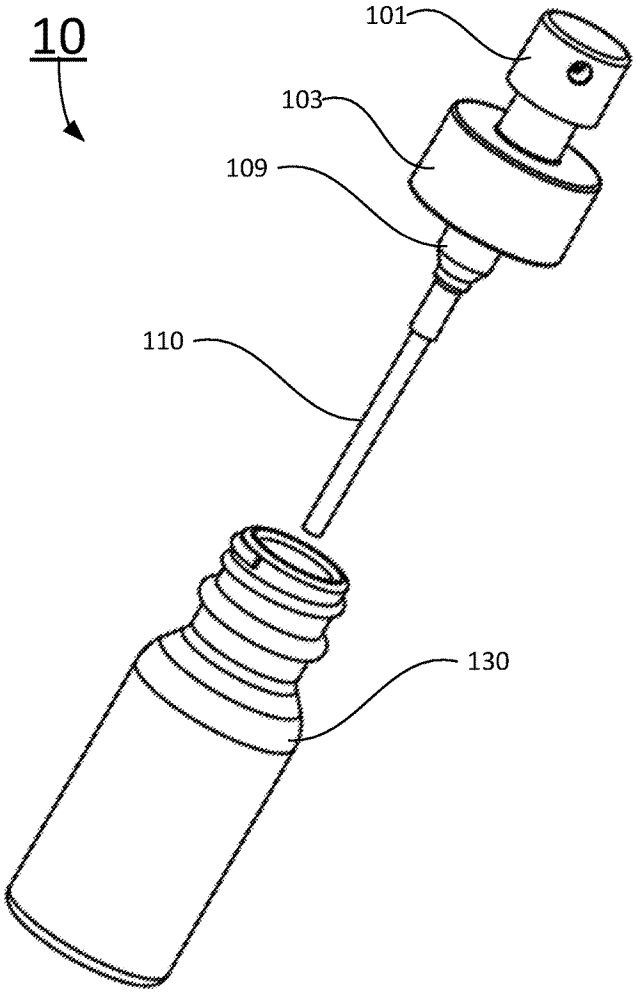
FIG. 1A is a perspective view of an exemplary E-liquid supply mechanism.
Figure 2:
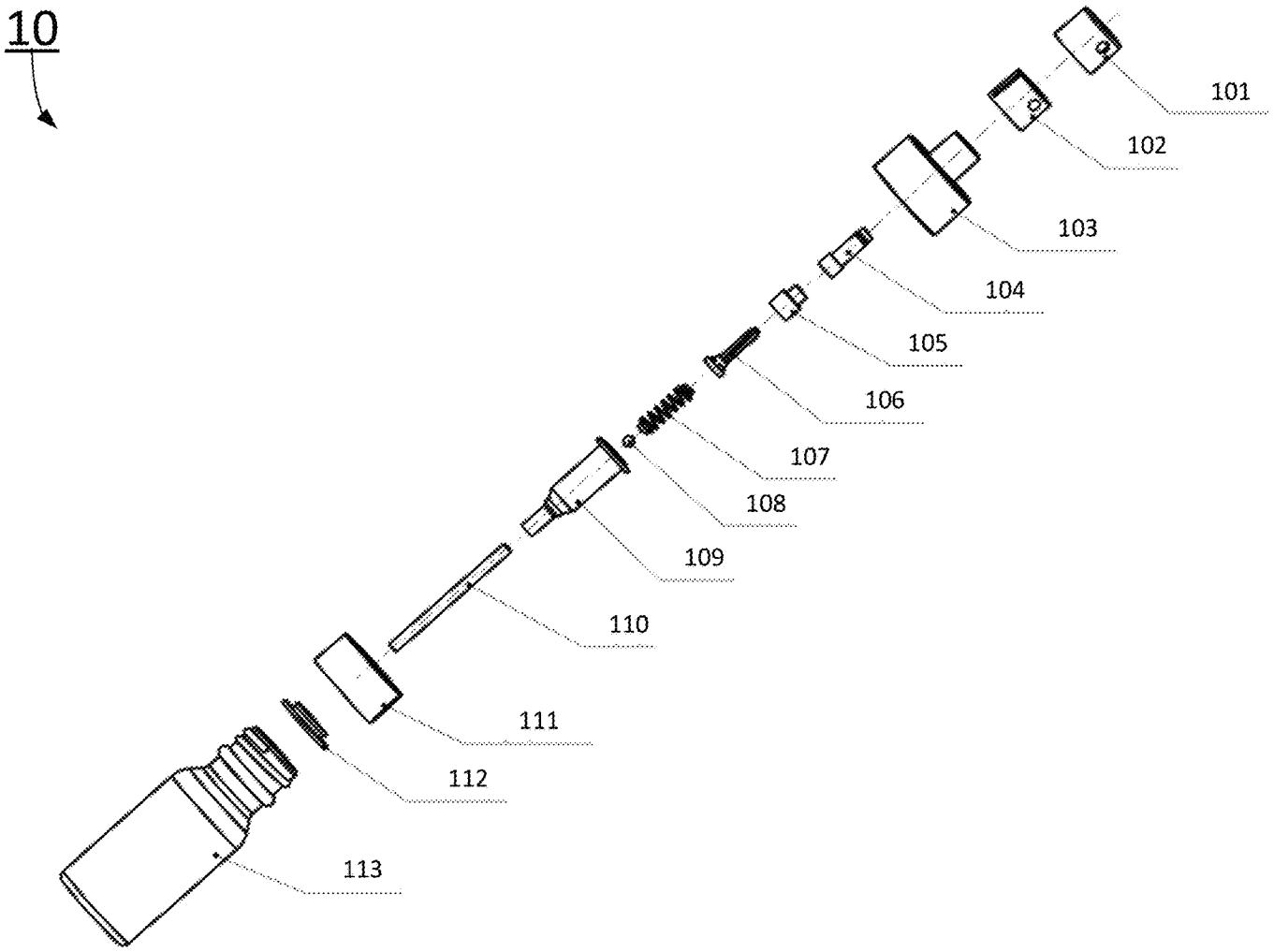
FIG. 2 is an exploded perspective view of the exemplary E-liquid supply mechanism according to certain embodiments of the present disclosure.
Figure 3:
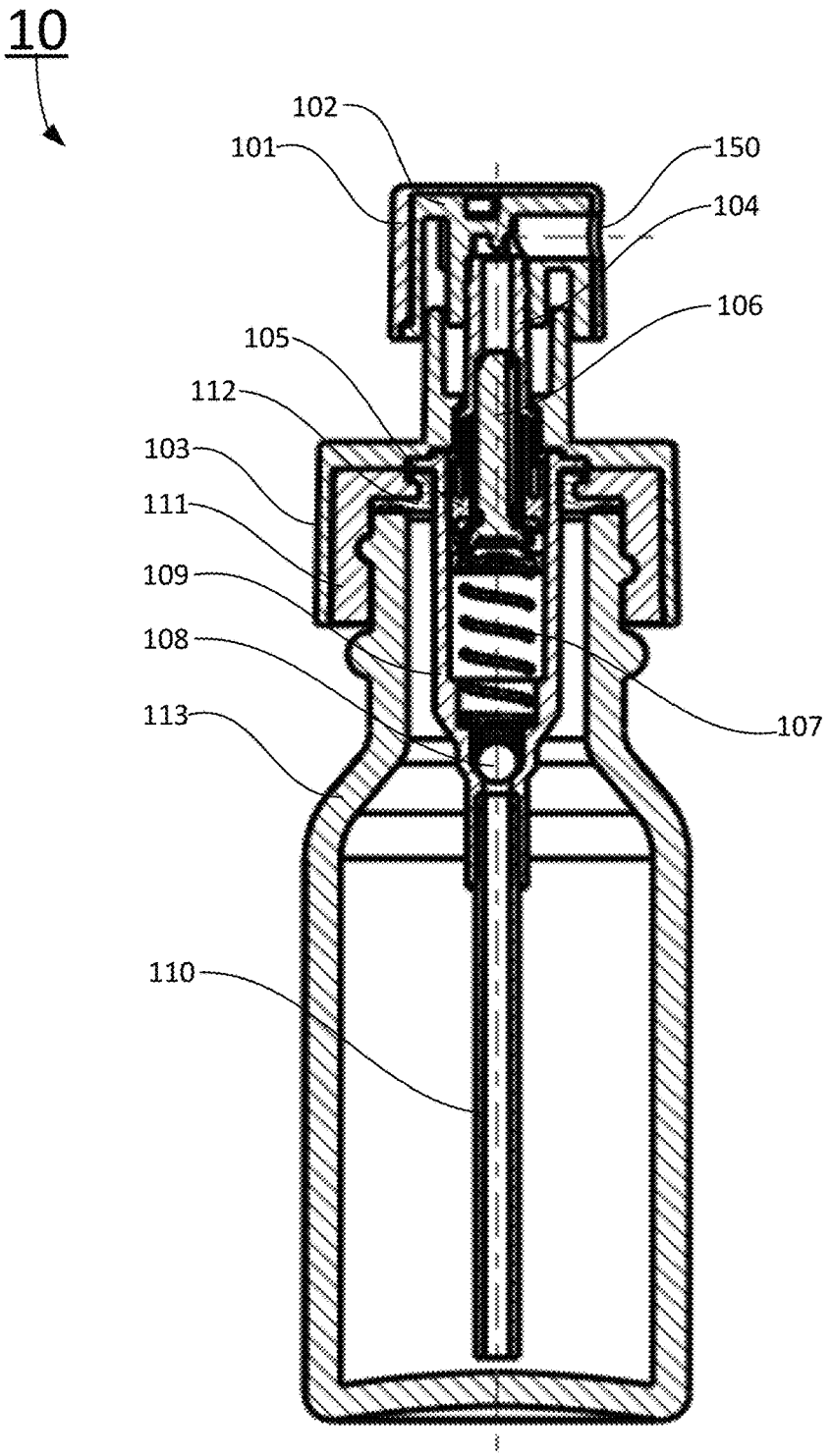
FIG. 3 is a cross-sectional view of the exemplary E-liquid supply mechanism according to certain embodiments of the present disclosure.

In one aspect, the present disclosure relates to an exemplary E-liquid supply mechanism 10. A perspective view of the E-liquid supply mechanism 10 is shown in FIG. 1A, and a side view of a portion of the E-liquid supply mechanism 10 is shown in FIG. 1B according to certain embodiments of the present disclosure. Detailed description of the E-liquid supply mechanism 10 are provided below in connection with the accompanying drawings FIGS. 2 through 3. FIG. 2 shows an exploded perspective view of the exemplary E-liquid supply mechanism 10 and FIG. 3 shows a cross-sectional view of the exemplary E-liquid supply mechanism 10 according to certain embodiments of the present disclosure.

In certain embodiments, the E-liquid supply mechanism 10 includes: a stationary portion, a movable portion, and an E-liquid bottle 113. The stationary portion includes an E-liquid bottle lid 103, an E-liquid supply mechanism body 109, and an E-liquid supply intake tube 110. The E-liquid supply mechanism body 109 is attached to the E-liquid bottle lid 103. The E-liquid supply intake tube 110 is attached to a low end of the E-liquid supply mechanism body 109. The movable portion is positioned inside of the E-liquid supply mechanism body 109. The movable portion includes a press button 102, a first E-liquid tube 104, a supply piston 105, a second E-liquid tube 106, a spring 107, and a steel ball 108. The first E-liquid tube 104 is attached to the press button 102. The supply piston 105 is attached to the first E-liquid tube 104. The second E-liquid tube 106 is attached to the supply piston 105. The spring 107 positioned under the second E-liquid tube 106, and the steel ball 108 positioned under the spring 107.

In certain embodiments, when the press button 102 is pressed by a user, the supply piston 105 pushes down the second E-liquid tube 106 to increase pressure inside the E-liquid supply mechanism body 109 and pushes E-liquid inside the E-liquid supply mechanism body 109 to flow through the second E-liquid tube 106, and the first E-liquid tube 104 to supply E-liquid through the press button 102. When the press button 102 is released, the spring 107 pushes the supply piston 105 upwards to decrease the pressure inside the E-liquid supply mechanism body 109 such that the E-liquid in the E-liquid bottle 113 enters the E-liquid supply mechanism body 109 through the low end of the E-liquid supply mechanism body 109.

In certain embodiments, the press button 102 includes an E-liquid supply mechanism connector 150. The E-liquid supply mechanism connector 150 is configured to connect to a flexible E-liquid tube 152 for supplying E-liquid inside the E-liquid supply mechanism body 109 to a vaporizer assembly 22 of an electronic cigarette. The press button 102 may also include a press button cover 101. The press button cover 101 defines an opening configured to connect the press button 102 to the E-liquid supply mechanism connector 150.

When the vaporizer assembly 22 is in need of E-liquid, the user can press the press button 102 in a reciprocating motion to supply E-liquid into the vaporizer assembly 22.

In certain embodiments, the flexible E-liquid tube 152 is transparent such that the user can see through the flexible E-liquid tube 152 to ascertain the vaporizer assembly 22 is supplied. The E-liquid bottle 113 may include a vertical transparent strip showing current level of E-liquid inside the E-liquid bottle 113 such that the user can determine when to replace the E-liquid bottle 113.

In certain embodiments, the E-liquid bottle 113 may also include an internal thread 111. The internal thread 111 of the E-liquid bottle 113 is configured to threadedly connect to an external thread of the E-liquid bottle 113 such that refill E-liquid to the electronic cigarette is completed by replacing the E-liquid bottle 113 available off shelf in an E-liquid retail store. The E-liquid supply mechanism 10 may also include a sealing ring 112. The sealing ring 112 is configured to seal the threaded connection between the E-liquid bottle lid 103 to the E-liquid bottle 113 to prevent E-liquid in the E-liquid bottle 113 from leaking out of the E-liquid bottle 113.

Figure 4:
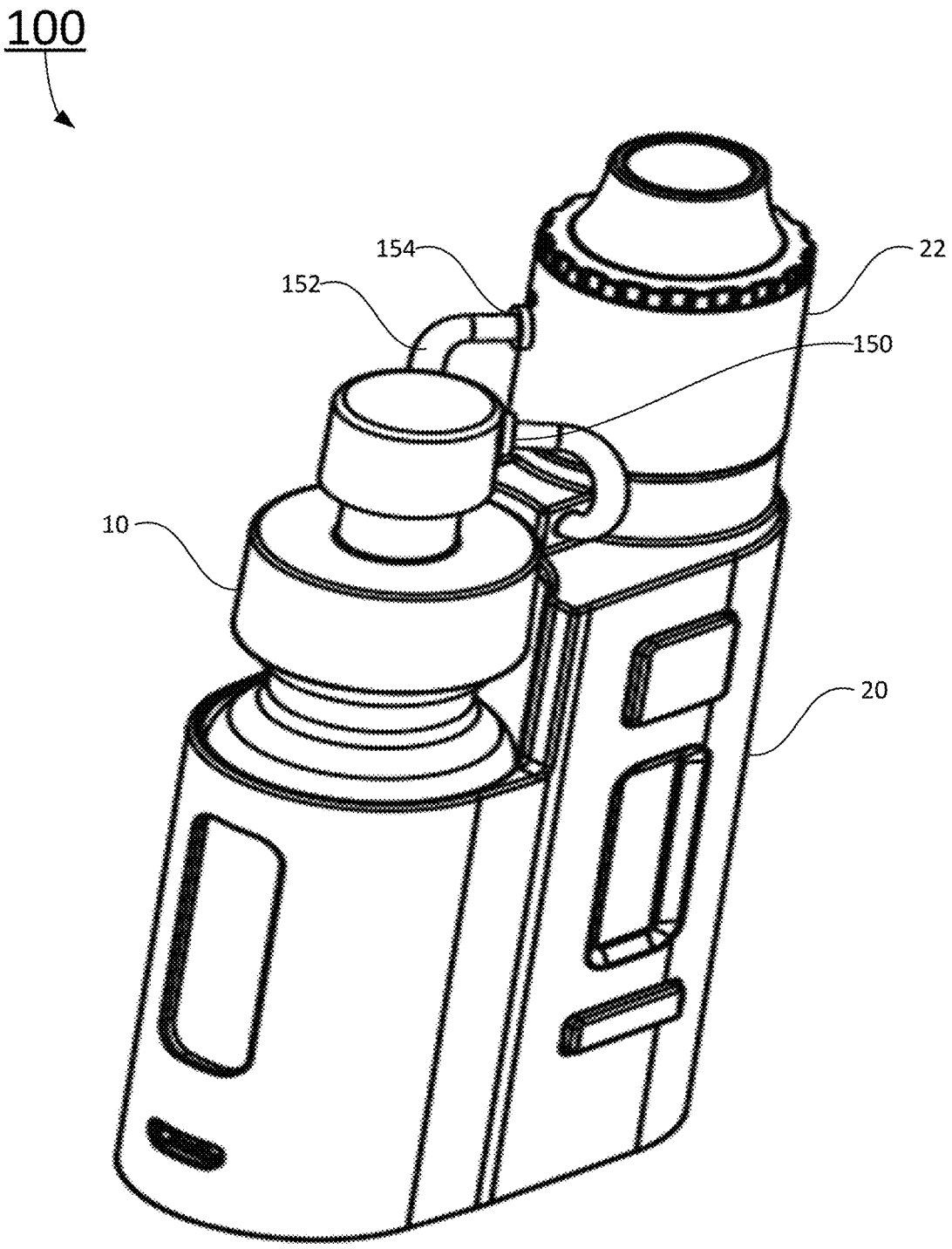
FIG. 4 is a perspective view of an exemplary electronic cigarette having the E-liquid supply mechanism according to certain embodiments of the present disclosure.
Figure 5:
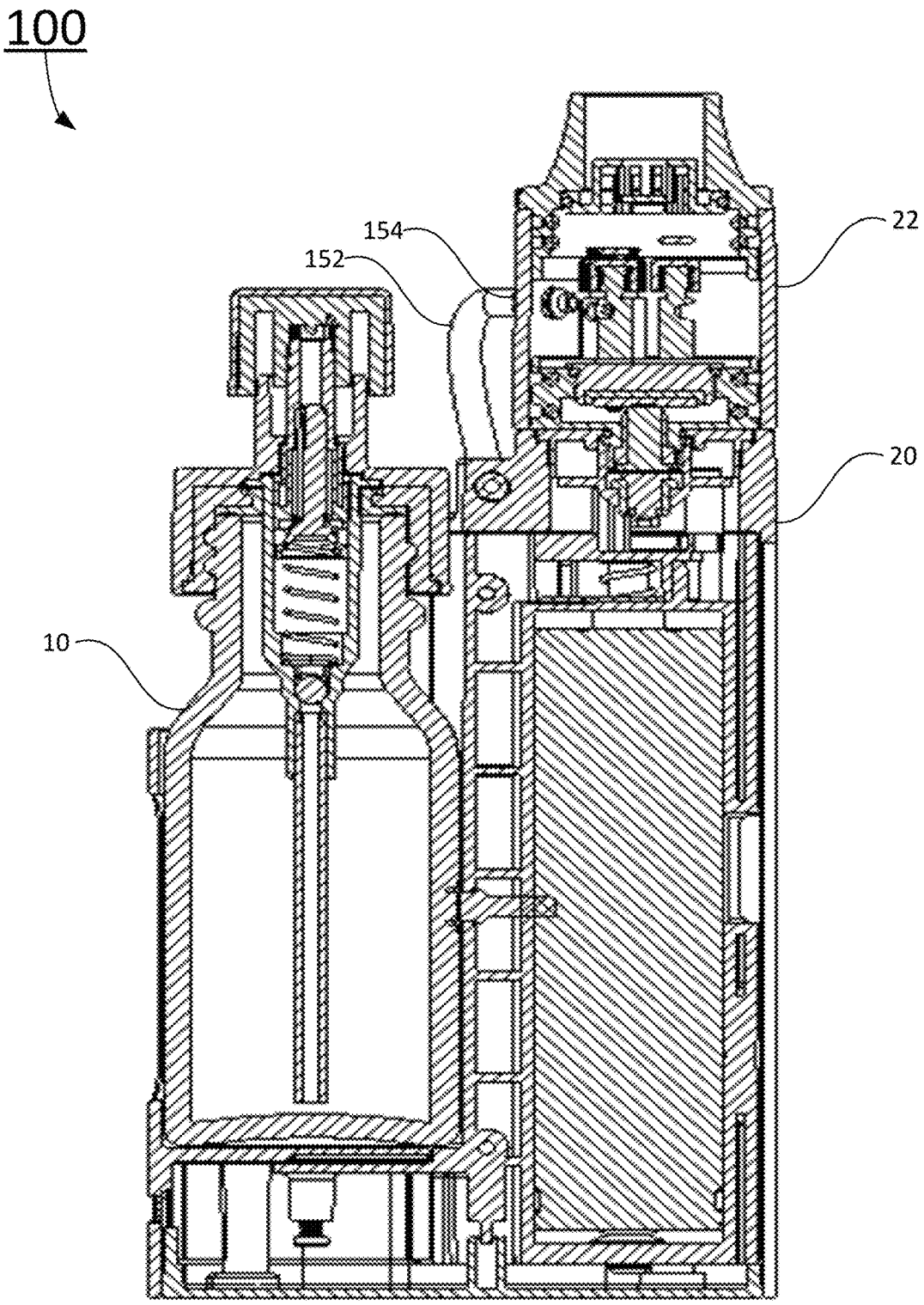
FIG. 5 is a cross-sectional view of the exemplary electronic cigarette having the E-liquid supply mechanism according to certain embodiments of the present disclosure.

In another aspect, the present disclosure relates to an exemplary electronic cigarette 100 having the E-liquid supply mechanism 10. Detailed description of the E-liquid supply mechanism 10 are provided below in connection with the accompanying drawings FIGS. 1 and 5. FIG. 4 show a perspective view and FIG. 5 shows a cross-sectional view of the electronic cigarette 100 according to certain embodiments of the present disclosure.

In certain embodiments, the electronic cigarette 100 includes an electronic cigarette body 20, an E-liquid supply mechanism 10, and a flexible E-liquid tube 152 configured to connect the E-liquid supply mechanism 10 to the electronic cigarette body 20 to supply E-liquid to the electronic cigarette body 20. In certain embodiments, the electronic cigarette body 20 includes a vaporizer assembly 22 and a vaporizer assembly E-liquid connector 154 configured to receive E-liquid supply through the flexible E-liquid tube 152 from the E-liquid supply mechanism 10.

In certain embodiments, the E-liquid supply mechanism 10 includes: a stationary portion, a movable portion, and an E-liquid bottle 113. The stationary portion includes an E-liquid bottle lid 103, an E-liquid supply mechanism body 109, and an E-liquid supply intake tube 110. The E-liquid supply mechanism body 109 is attached to the E-liquid bottle lid 103. The E-liquid supply intake tube 110 is attached to a low end of the E-liquid supply mechanism body 109. The movable portion is positioned inside of the E-liquid supply mechanism body 109. The movable portion includes a press button 102, a first E-liquid tube 104, a supply piston 105, a second E-liquid tube 106, a spring 107, and a steel ball 108. The first E-liquid tube 104 is attached to the press button 102. The supply piston 105 is attached to the first E-liquid tube 104. The second E-liquid tube 106 is attached to the supply piston 105. The spring 107 positioned under the second E-liquid tube 106, and the steel ball 108 positioned under the spring 107.

In certain embodiments, when the press button 102 is pressed by a user, the supply piston 105 pushes down the second E-liquid tube 106 to increase pressure inside the E-liquid supply mechanism body 109 and pushes E-liquid inside the E-liquid supply mechanism body 109 to flow through the second E-liquid tube 106, and the first E-liquid tube 104 to supply E-liquid through the press button 102. When the press button 102 is released, the spring 107 pushes the supply piston 105 upwards to decrease the pressure inside the E-liquid supply mechanism body 109 such that the E-liquid in the E-liquid bottle 113 enters the E-liquid supply mechanism body 109 through the low end of the E-liquid supply mechanism body 109.

In certain embodiments, the press button 102 includes an E-liquid supply mechanism connector 150. The E-liquid supply mechanism connector 150 is configured to connect to the flexible E-liquid tube 152 for supplying E-liquid inside the E-liquid supply mechanism body 109 to the vaporizer assembly 22 of the electronic cigarette 100. The press button 102 may also include a press button cover 101. The press button cover 101 defines an opening configured to connect the press button 102 to the E-liquid supply mechanism connector 150.

When the vaporizer assembly 22 is in need of E-liquid, the user can press the press button 102 in a reciprocating motion to supply E-liquid into the vaporizer assembly 22.

In certain embodiments, the flexible E-liquid tube 152 is transparent such that the user can see through the flexible E-liquid tube 152 to ascertain the vaporizer assembly 22 is supplied. The E-liquid bottle 113 may include a vertical transparent strip showing current level of E-liquid inside the E-liquid bottle 113 such that the user can determine when to replace the E-liquid bottle 113.

In certain embodiments, the E-liquid bottle 113 may also include an internal thread 111. The internal thread 111 of the E-liquid bottle 113 is configured to threadedly connect to an external thread of the E-liquid bottle 113 such that refill E-liquid to the electronic cigarette is completed by replacing the E-liquid bottle 113 available off shelf in an E-liquid retail store. The E-liquid supply mechanism 10 may also include a sealing ring 112. The sealing ring 112 is configured to seal the threaded connection between the E-liquid bottle lid 103 to the E-liquid bottle 113 to prevent E-liquid in the E-liquid bottle 113 from leaking out of the E-liquid bottle 113.

Figure 6A:
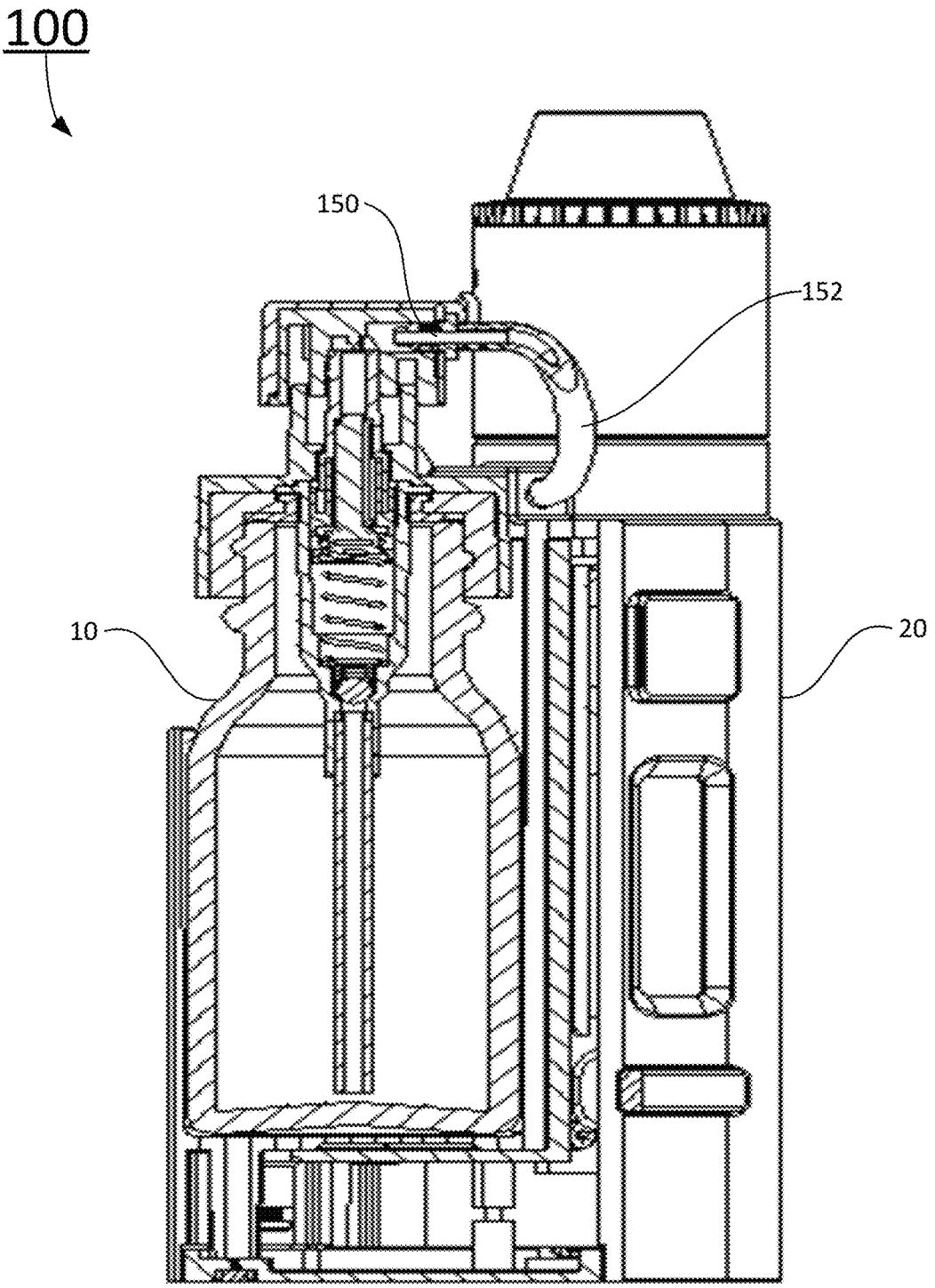
FIG. 6A shows E-liquid is pushed out of the E-liquid supply mechanism.
Figure 6B:
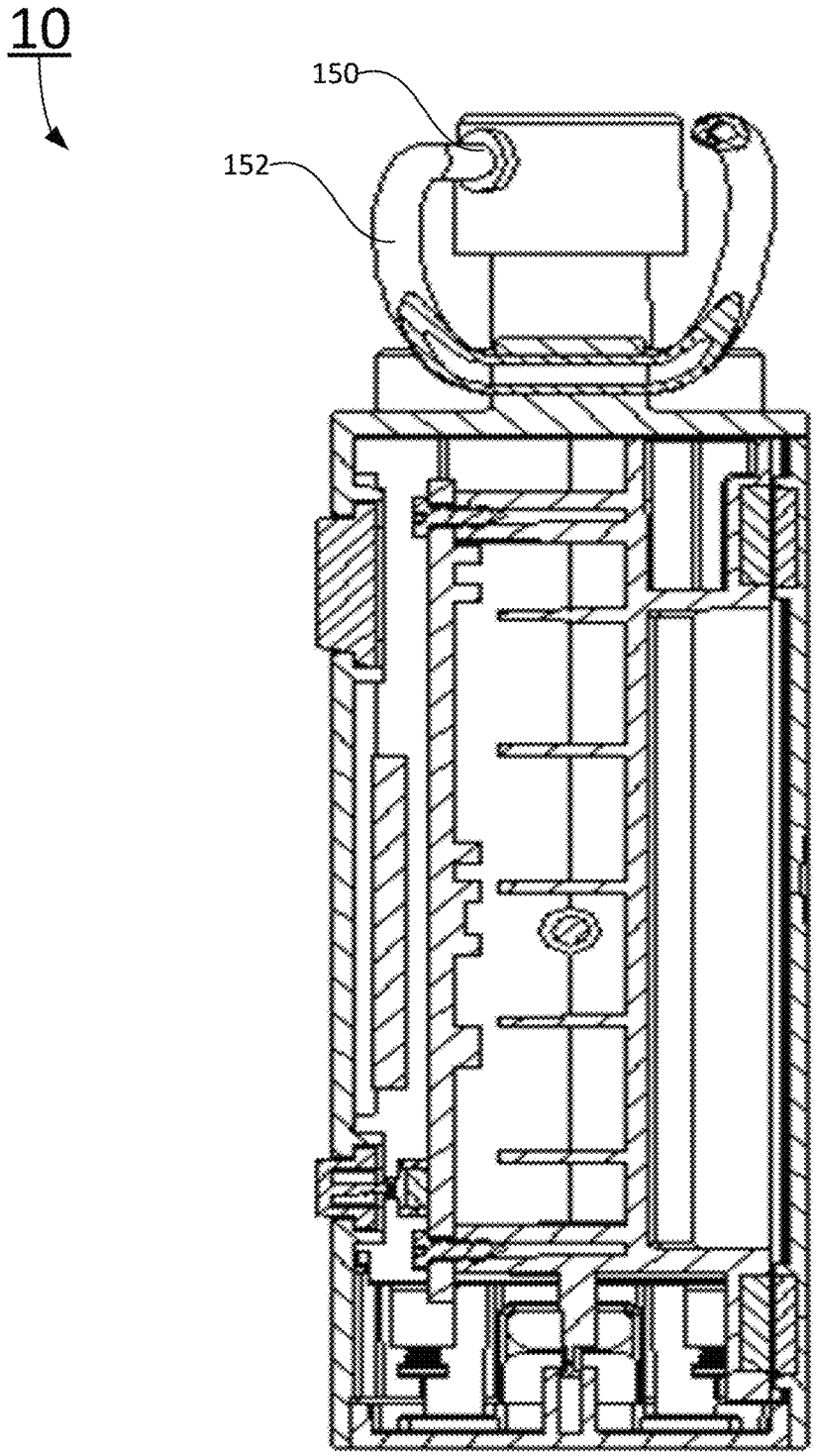
FIG. 6B shows E-liquid passes through a flexible E-liquid tube.
Figure 6C:
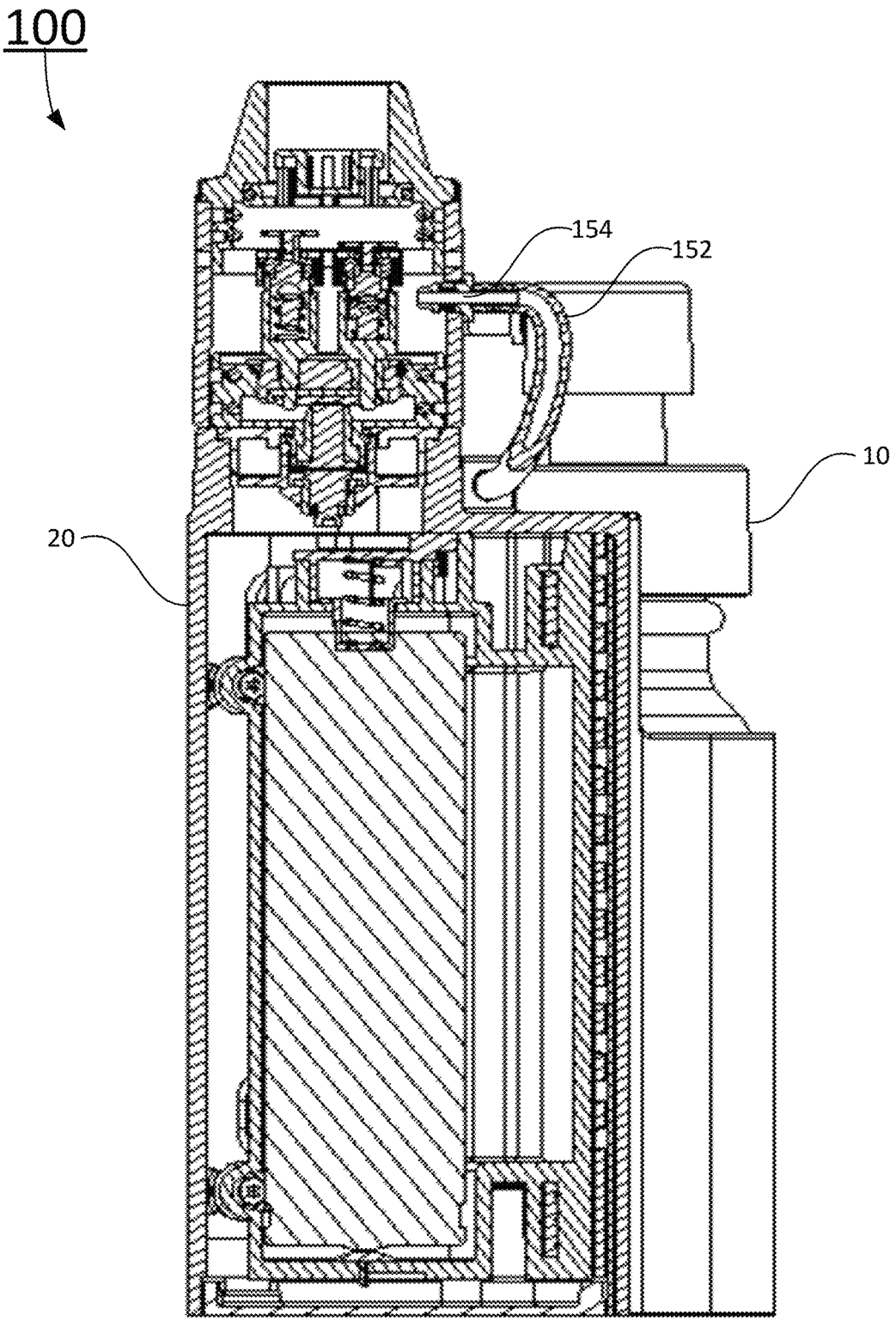
FIG. 6C shows E-liquid is received by a vaporizer assembly according to certain embodiments of the present disclosure.

Referring now to FIGS. 6A through 6C, E-liquid supply flow is shown according to certain embodiments of the present disclosure. In FIG. 6A, a cross-sectional view of the E-liquid supply mechanism 10 shows the E-liquid is pushed out of the E-liquid supply mechanism 10 at the E-liquid supply mechanism connector 150. In FIG. 6B, a cross-sectional view of the flexible E-liquid tube 152 shows the E-liquid from the E-liquid supply mechanism connector 150 passes through the flexible E-liquid tube 152. In FIG. 6C, a cross-sectional view of the electronic cigarette body 20 shows the E-liquid is received by the vaporizer assembly through the vaporizer assembly E-liquid connector 154.

In yet another aspect, the present disclosure relates to a method of using an electronic cigarette 100. In certain embodiments, the method includes: connecting a flexible E-liquid tube 152 from an E-liquid supply mechanism connector 150 of an E-liquid supply mechanism 10 to a vaporizer assembly E-liquid connector 154 of an electronic cigarette body 20, pressing, by a user, a press button 102 of the E-liquid supply mechanism 10 in a reciprocating motion one or more times to supply E-liquid from an E-liquid bottle 113 to a vaporizer assembly 22 of the electronic cigarette body 20, and switching on a power supply module of the electronic cigarette body 20 to energize a heating element inside the vaporizer assembly 22 to generate E-liquid vapor.

In certain embodiments, the method includes refilling E-liquid in the E-liquid bottle 113. The refilling includes: unscrewing an internal thread 111 of an E-liquid bottle lid 103 from an external thread of the E-liquid bottle 113 to detach the E-liquid bottle 113 as shown in FIG. 1A, and replacing a new E-liquid bottle 113 available off shelf in an E-liquid retail store.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to activate others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims, the foregoing description and the exemplary embodiments described therein, and accompanying drawings.

What is claimed is:

1. An E-liquid supply mechanism, comprising:

a stationary portion having an E-liquid bottle lid, an E-liquid supply mechanism body, and an E-liquid supply intake tube, wherein the E-liquid supply mechanism body is attached to the E-liquid bottle lid, and the E-liquid supply intake tube is attached to a low end of the E-liquid supply mechanism body; and a movable portion positioned inside of the E-liquid supply mechanism body, wherein the movable portion comprises a press button, a first E-liquid tube attached to the press button, a supply piston attached to the first E-liquid tube, a second E-liquid tube attached to the supply piston, a spring positioned under the second E-liquid tube, and a steel ball positioned under the spring, wherein the press button comprises an E-liquid supply mechanism connector for connecting to a flexible E-liquid tube and supplying E-liquid inside the E-liquid supply mechanism body to a vaporizer assembly of an electronic cigarette; and an E-liquid bottle, wherein when the press button is pressed by a user, the supply piston pushes down the second E-liquid tube to increase pressure inside the E-liquid supply mechanism body and pushes E-liquid inside the E-liquid supply mechanism body to flow through the second E-liquid tube, and the first E-liquid tube to supply E-liquid through the press button, and when the press button is released, the spring pushes the supply piston upwards to decrease the pressure inside the E-liquid supply mechanism body such that the E-liquid in the E-liquid bottle enters the E-liquid supply mechanism body through the low end of the E-liquid supply mechanism body.

2. The E-liquid supply mechanism of claim 1, wherein the press button comprises:

a press button cover defining an opening for connecting the press button to the E-liquid supply mechanism connector.

3. The E-liquid supply mechanism of claim 1, wherein when the vaporizer assembly is in need of E-liquid, the user presses the press button in a reciprocating motion to supply E-liquid into the vaporizer assembly.

4. The E-liquid supply mechanism of claim 1, wherein the flexible E-liquid tube is transparent such that the user can see through the flexible E-liquid tube to ascertain the vaporizer assembly is supplied.

5. The E-liquid supply mechanism of claim 1, wherein the E-liquid bottle comprises a vertical transparent strip showing current level of E-liquid inside the E-liquid bottle such that the user can determine when to replace the E-liquid bottle.

6. The E-liquid supply mechanism of claim 1, further comprising an internal thread of the E-liquid bottle lid configured to threadedly connect to an external thread of the E-liquid bottle such that refill E-liquid to the electronic cigarette comprises replacing the E-liquid bottle available off shelf in an E-liquid retail store.

7. The E-liquid supply mechanism of claim 6, further comprising a sealing ring configured to seal the threaded connection between the E-liquid bottle lid to the E-liquid bottle to prevent E-liquid in the E-liquid bottle from leaking out of the E-liquid bottle.

8. An electronic cigarette comprising the E-liquid supply mechanism of claim 1.

9. An electronic cigarette, comprising:

an electronic cigarette body having a vaporizer assembly and a vaporizer assembly E-liquid connector configured to receive E-liquid supply through a flexible E-liquid tube; and an E-liquid supply mechanism including:

a stationary portion positioned on an E-liquid bottle lid, the stationary portion comprising the E-liquid bottle lid, an E-liquid supply mechanism body attached to the E-liquid bottle lid, and an E-liquid supply intake tube attached to a low end of the E-liquid supply mechanism body; and a movable portion positioned inside of the E-liquid supply mechanism body, wherein the movable portion comprises a press button, a first E-liquid tube attached to the press button, a supply piston attached to the first E-liquid tube, a second E-liquid tube attached to the supply piston, a spring positioned under the second E-liquid tube, and a steel ball positioned under the spring, wherein the press button comprises an E-liquid supply mechanism connector for connecting to a flexible E-liquid tube and supplying E-liquid inside the E-liquid supply mechanism body to a vaporizer assembly of an electronic cigarette; and an E-liquid bottle, wherein when the press button is pressed by a user, the supply piston pushes down the second E-liquid tube to increase pressure inside the E-liquid supply mechanism body and pushes E-liquid inside the E-liquid supply mechanism body to flow through the second E-liquid tube, and the first E-liquid tube to supply E-liquid through the press button, and when press button is released, the spring pushes the supply piston upwards to decrease the pressure inside the E-liquid supply mechanism body such that the E-liquid in a E-liquid bottle enters the E-liquid supply mechanism body through the low end of the E-liquid supply mechanism body.

10. The electronic cigarette of claim 9, wherein the press button comprises:

a press button cover defining an opening for connecting the press button to the E-liquid supply mechanism connector.

11. The electronic cigarette of claim 9, wherein when the vaporizer assembly is in need of E-liquid, the user presses the press button in a reciprocating motion to supply E-liquid into the vaporizer assembly through the flexible E-liquid tube.

12. The electronic cigarette of claim 9, wherein the flexible E-liquid tube is transparent such that the user can see through the flexible E-liquid tube to ascertain the vaporizer assembly is supplied.

13. The electronic cigarette of claim 9, wherein the E-liquid bottle comprises a vertical transparent strip showing current level of E-liquid inside the E-liquid bottle such that the user can determine when to replace the E-liquid bottle.

14. The electronic cigarette of claim 9, further comprising an internal thread of the E-liquid bottle lid configured to threadedly connect an external thread of the E-liquid bottle such that refill E-liquid to the electronic cigarette comprises replacing the E-liquid bottle available off shelf in an E-liquid retail store.

15. The electronic cigarette of claim 14, further comprising a sealing ring configured to seal the threaded connection between the E-liquid bottle lid to the E-liquid bottle to prevent E-liquid in the E-liquid bottle from leaking out of the E-liquid bottle.

16. The electronic cigarette of claim 9, wherein the vaporizer assembly comprises a vaporizer, a heating element, and an E-liquid medium, wherein when the E-liquid enters the vaporizer assembly, and absorbed by the E-liquid medium, the user can switch on an electrical power supply from a power module to energize the heating element and vaporize the E-liquid absorbed in the E-liquid medium.

17. A method of using an electronic cigarette, comprising:

connecting a flexible E-liquid tube from an E-liquid supply mechanism connector of an E-liquid supply mechanism to a vaporizer assembly E-liquid connector of an electronic cigarette body;

pressing a press button of the E-liquid supply mechanism in a reciprocating motion one or more times to supply E-liquid from an E-liquid bottle to a vaporizer assembly of the electronic cigarette body; and switching on a power supply module of the electronic cigarette body to energize a heating element inside the vaporizer assembly to generate E-liquid vapor.

18. The method of claim 17, further comprising: refilling E-liquid in the E-liquid bottle, wherein refilling comprises:

unscrewing an internal thread of an E-liquid bottle lid from an external thread of the E-liquid bottle to detach the E-liquid bottle; and replacing a new E-liquid bottle available off shelf in an E-liquid retail store.

* * * * *